US006091209A

United States Patent [19]

Hilgers

[11] Patent Number: 6,091,209

[45] Date of Patent: Jul. 18, 2000

[54] PIEZOELECTRIC TRANSFORMER DISCHARGE LAMP OPERATING CIRCUIT WITH DUTY CYCLE DIMMING CIRCUIT

[75] Inventor: Achim Hilgers, Aachen, Germany

[73] Assignee: U.S. Philips Corporation, New York, N.Y.

[21] Appl. No.: 09/093,214

[22] Filed: Jun. 8, 1998

[30] Foreign Application Priority Data

Jul. 22, 1997 [EP] European Pat. Off. ..... 97202287

[51] Int. Cl.[7] ..... H05B 37/02

[52] U.S. Cl. ..... 315/291; 315/276; 315/307

[58] Field of Search ..... 315/276, 277, 315/279, 307, 291, DIG. 4

[56] References Cited

U.S. PATENT DOCUMENTS 4,864,482 9/1989 Quazi et al. ..... 363/37
5,329,200 7/1994 Zaitsu ..... 310/316

FOREIGN PATENT DOCUMENTS

0758159A2 2/1997 European Pat. Off. ..... H20M 3/28
2611135A1 10/1977 Germany .

*Primary Examiner*—David Vu
*Attorney, Agent, or Firm*—Bernard Franzblau

[57] ABSTRACT

A circuit arrangement for operating a lamp comprising input terminals for connection to a supply voltage source. A DC-AC converter is coupled to said input terminals for generating a high frequency signal. A piezoelectric transformer having a primary side that is coupled to the DC-AC converter and a secondary side that is coupled to terminals for lamp connection and a dimming circuit for adjusting the light output of the lamp. The DC-AC converter generates a substantially square wave shaped signal and the dimming circuit is coupled to the DC-AC converter for adjusting the lamp light output by adjusting the duty cycle of the substantially square wave shaped signal. A lamp operated by the circuit arrangement is dimmable over a wide range while the amount of power dissipated in the circuit arrangement is relatively low, even when the lamp is dimmed.

21 Claims, 2 Drawing Sheets

PIEZOELECTRIC TRANSFORMER DISCHARGE LAMP OPERATING CIRCUIT WITH DUTY CYCLE DIMMING CIRCUIT

BACKGROUND OF THE INVENTION

This invention relates to a circuit arrangement for operating a lamp comprising input terminals for connection to a supply voltage source, a DC-AC-converter coupled to said input terminals for generating a high frequency signal, a piezo-electric transformer having a primary side that is coupled to the DC-AC-converter and a secondary side that is coupled to terminals for lamp connection, and means for adjusting the light output of the lamp.

The invention also relates to a compact lamp and a liquid crystal display.

A circuit arrangement as mentioned in the opening paragraph is known from DE-OS 2611135. In the known circuit arrangement the DC-AC-converter comprises a self-oscillating circuit so that the signal that is present at the primary side of the piezotransformer during operation of the circuit arrangement is substantially sinusoidal. Dimming or adjusting the light output of the lamp is realized by adjusting the amplitude of the voltage that is present at the primary side of the piezo-electric transformer. This can be done for instance by coupling a transistor or potentiometer between the DC-AC-converter and the primary side of the piezo-electric transformer and adjusting the conductivity of the transistor or the resistance of the potentiometer respectively. A disadvantage of this way of dimming is that when the light output is adjusted to a relatively low level, a relatively high amount of power is dissipated in the transistor or the potentiometer respectively. Therefore, the efficacy of the known circuit arrangement is relatively low when the lamp is dimmed.

SUMMARY OF THE INVENTION

The invention aims to provide a circuit arrangement for operating a lamp having a relatively high efficacy, even when the lamp is dimmed.

A circuit arrangement as mentioned in the opening paragraph is therefore according to the invention characterized in that the DC-AC-converter comprises a circuit part I for generating a substantially square wave shaped signal and the means for adjusting the light output of the lamp comprise a dimming circuit coupled to the circuit part I for adjusting the duty cycle of the substantially square wave shaped signal.

During operation of a circuit arrangement according to the invention a substantially square wave voltage (that is either the substantially square wave signal or, in case the DC-AC-converter comprises an amplifier, the amplified substantially square wave shaped signal) is present at the primary side of the piezotransformer. The voltage transformation ratio (Vout/Vin) of the piezotransformer is only (very) high for sinusoidally shaped signals having a frequency that is within a narrow range comprising a resonance frequency of the piezotransformer. Since, according to a Fourier analysis, the substantially square wave shaped voltage present at the primary side of the piezotransformer can be considered as an infinite sum of sinusoidally shaped signals of an increasing frequency, the piezo transformer effectively only transforms the sinusoidally shaped signal, that has a frequency within such a narrow range and that has not too small an amplitude, to a sinusoidal signal that is present at the secondary side of the transformer and has the same frequency but an increased amplitude. The piezotransformer thus behaves as if only a sinusoidal signal at a frequency within the narrow range were present at its primary side. Normally the frequency of the square wave signal is chosen so that (only) its first harmonic term is within the narrow range comprising a resonance frequency. When the duty cycle of the substantially square wave shaped signal is adjusted by means of the dimming circuit the amplitudes of all the sinusoidal signals which together make up the square wave voltage are changed. The amplitude of the sinusoidal signal having a frequency within the narrow range is also changed so that as a result the amplitude of the sinusoidal signal present at the secondary side of the transformer is changed as well. In case this latter amplitude is decreased, the lamp that is operated by the circuit arrangement is dimmed. It has been found that a circuit arrangement according to the invention has a relatively high efficacy, also when the lamp operated by the circuit arrangement is dimmed.

In a preferred embodiment of a circuit arrangement according to the invention, the circuit part I comprises an integrated circuit. When use is made of one or more integrated circuits to generate the substantially square wave shaped signal, the circuit part I can be realized in a relatively simple and inexpensive way. Preferably the DC-AC-converter comprises an amplifier coupled between the circuit part I and the primary side of the piezo-electric transformer for amplifying the substantially square wave shaped signal to a substantially square wave shaped voltage having the same frequency as the substantially square wave shaped signal but a higher amplitude. When use is made of such an amplifier the substantially square wave shaped signal generated by the circuit part I can be a low power signal as is typically the case when the circuit part I comprises one or more relatively cheap integrated circuits for generating the substantially square wave shaped signal. The substantially square wave shaped voltage is present at the primary side of the piezotransformer. The DC-AC-converter is thus realized in a relatively simple and inexpensive way. Good results have been obtained for configurations wherein the amplifier comprises a series arrangement of inductive means and switching means and wherein the switching means are shunting the primary side of the piezo-electric transformer. The inductive means are in series with the primary side of the piezotransformer. This primary side forms a capacitive impedance. A control electrode of the switching element is coupled to an output of the circuit part I where the substantially square wave shaped signal is present. It has been found that, when use is made of such a configuration of the amplifier, the substantially square wave shaped signal is amplified effectively by relatively simple means. Additionally, the inductive means prevents the primary side of the piezotransformer from carrying currents with a relatively high amplitude.

Preferably the circuit arrangement comprises a circuit part II for adjusting the frequency of the substantially square wave shaped signal dependent upon the resonance frequency of the piezotransformer. When the duty cycle of the substantially square wave shaped signal is changed, the amount of power consumed by the lamp also changes. As a result the impedance of the lamp and therewith the resonance frequency of the piezo-electric transformer change as well. The frequency of the square wave shaped signal is adjusted so that the sinusoidally shaped signal that lies within a narrow range comprising the resonance frequency of the piezo transformer, stays within that range when during dimming the resonance frequency changes. In this way the efficacy of the circuit arrangement is maintained at a relatively high level during dimming. The adjustment of the frequency can be realized in a relatively simple and dependable way in the case where the circuit part II comprises a phase locked loop or an amplitude locked loop.

Since the piezo-electric transformer is small and flat, a circuit arrangement according to the invention is very suitable to be used in the ballast means of a compact lamp, such as for instance a compact fluorescent lamp, comprising a light source provided with a vessel which is closed in a gastight manner and transmissive for visible radiation, a housing connected to the light source and provided with a lamp cap, ballast means electrically connected to the light source for operating the light source and positioned at least partly in a space surrounded by the housing.

The fact that the piezo electric transformer is small and flat makes a circuit arrangement according to the invention also very suitable for use in a ballast means of a liquid crystal display comprising a backlight equipped with a lamp and ballast means for operating the lamp.

BRIEF DESCRIPTION OF THE DRAWING

An embodiment of a circuit arrangement according to the invention will now be described with reference to a drawing.

In the drawing

DESCRIPTION OF THE PREFERRED EMBODIMENTS

Figure 1:
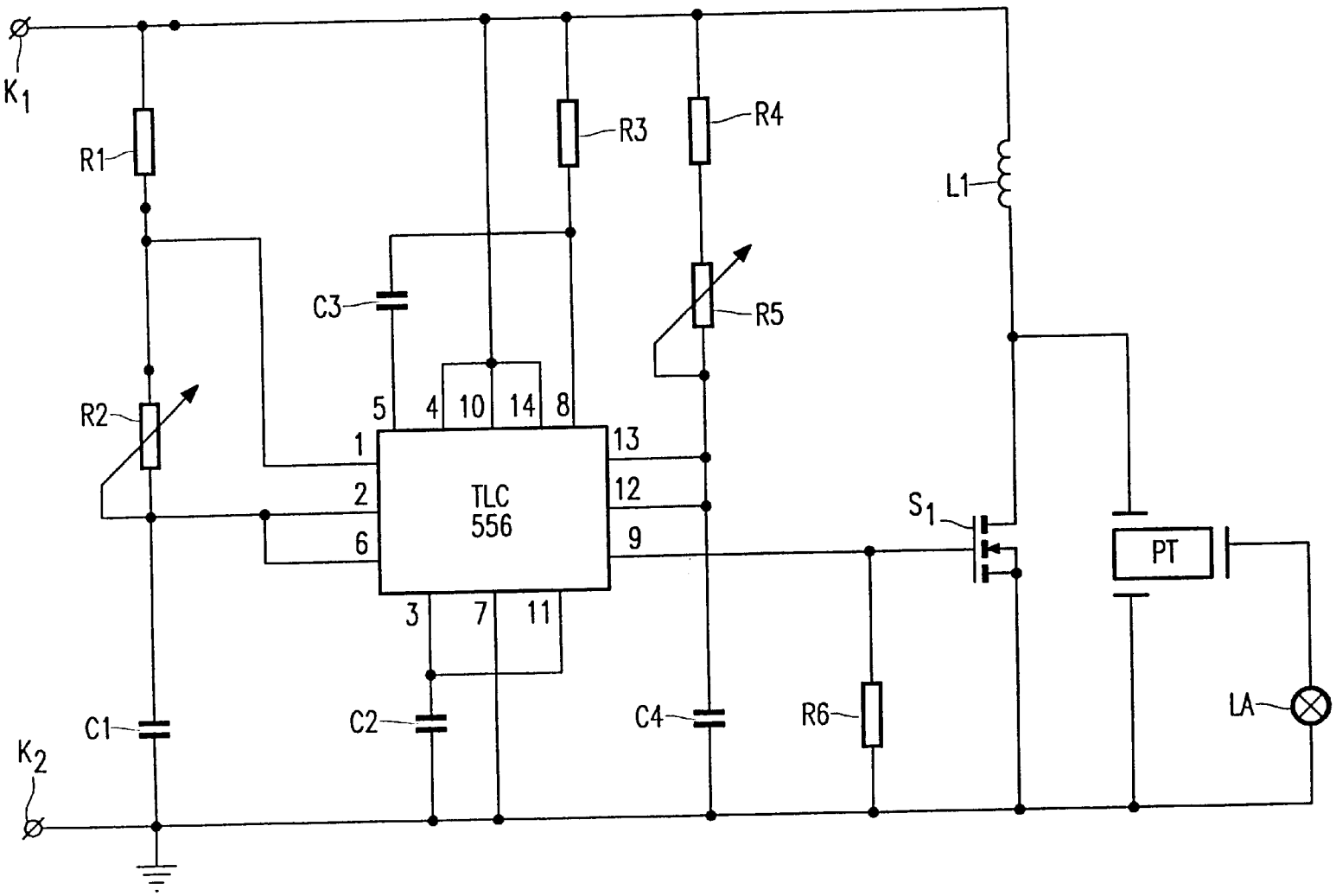
FIG. 1 shows a schematic representation of an embodiment of a circuit arrangement according to the invention with a lamp connected to it.

In FIG. 1 K1 and K2 are input terminals for connection to the poles of a source of DC voltage. Input terminals K1 and K2 are connected by means of a series arrangement of ohmic resistor R1, potentiometer R2 and capacitor C1. Input terminals K1 and K2 are also connected by means of a series arrangement of ohmic resistor R4, potentiometer R5 and capacitor C4 and by means of a series arrangement of inductance L1 and switching element S1. A common terminal of resistor R1 and potentiometer R2 is connected to an input terminal 1 of integrated circuit TLC 556. This integrated circuit TLC 556 comprises two timers. A common terminal of potentiometer R2 and capacitor C1 is connected with both input terminals 2 and 6 of integrated circuit TLC 556. Input terminal K1 is connected to input terminals 4, 10 and 14 of integrated circuit TLC 556. Terminal K1 is also connected to input terminal 5 of the integrated circuit by means of a series arrangement of ohmic resistor R3 and capacitor C3 and to input terminal 8 by means of ohmic resistor R3. Input terminal K2 is directly connected to input terminal 7 and also is connected to input terminals 3 and 11 by means of a capacitor C2. A common terminal of potentiometer R5 and capacitor C4 is connected to both input terminal 12 and input terminal 13 of the integrated circuit. Output terminal 9 of the integrated circuit is connected to a control electrode of switching element S1. The control electrode of switching element S1 is connected to input terminal K2 by means of ohmic resistor R6. A common terminal of inductance L1 and switching element S1 is connected to a first input terminal of piezoelectric transformer PT. A second input terminal (that also functions as a second output terminal) is connected to input terminal K2. A lamp La is connected between a first output terminal and the second output terminal of piezoelectric transformer PT. Circuit part I for generating a substantially square wave shaped signal is formed by the integrated circuit TLC 556, resistors R1, R3 and R4, potentiometers R2 and R5 and capacitors C1, C2, C3 and C4. Resistor R6, inductance L1, switching element S1 and the capacitance associated with the input terminals of piezotransformer PT together form an amplifier. Circuit part I and the amplifier together form a DC-AC-converter.

The operation of the circuit arrangement shown in FIG. 1 is as follows.

When input terminals K1 and K2 are connected to the poles of a DC voltage source, integrated circuit TLC 556 generates a substantially square wave shaped signal that is present at the output terminal 9. The substantially square wave shaped signal present at output terminal 9 renders the switching element S1 conductive and non-conductive at a frequency f1. As a result the substantially square wave shaped signal is amplified by the amplifier to a substantially square wave shaped voltage of the same frequency but with a substantially higher amplitude that is present between the input terminals of the piezoelectric transformer. The frequency of the substantially square wave shaped signal (or voltage) can be adjusted by means of adjusting the resistance of potentiometer R2. The frequency f1 of the substantially square wave shaped signal is adjusted to such a value that one of the sinusoidal signals that together form the substantially square wave shaped signal has a frequency f2 that is very close to one of the resonance frequencies of the piezoelectric transformer. The sinusoidal signal with frequency f2 is transformed to another sinusoidal signal with frequency f2 and an increased amplitude by means of piezotransformer PT. This latter sinusoidal signal is present between the output terminals of the piezotransformer and thus across the lamp La.

The duty cycle of the substantially square wave shaped signal can be adjusted by means of adjusting the resistance of potentiometer R5. A change of the duty cycle of the substantially square wave shaped signal causes a change in the amplitude of each of the sinusoidal signals that together make up the substantially square wave shaped signal. The amplitude of the sinusoidal signal with frequency f2 that is transformed to the output voltage of the piezotransformer PT is thus changed as well. As a result the amplitude of the output voltage of the piezotransformer is also changed, causing a corresponding increase or decrease in the light output of the lamp La.

Figure 2:
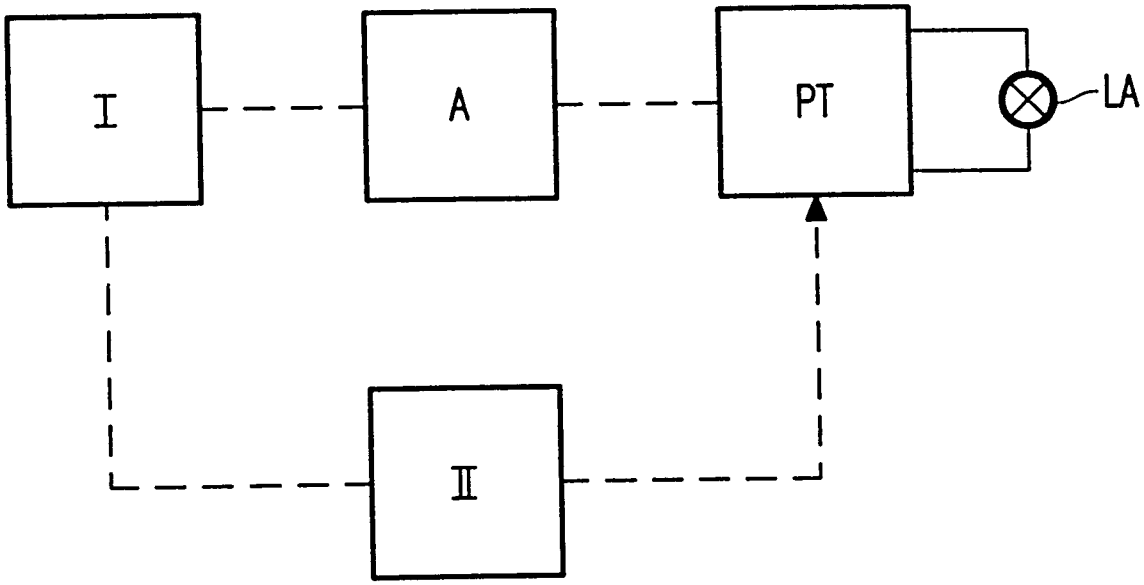
FIG. 2 shows a schematic representation of a further embodiment of a circuit arrangement according to the invention with a lamp connected to it.

In FIG. 2 I is a circuit part for generating a substantially square wave shaped signal. A is an amplifier for amplifying the substantially square wave shaped signal to a substantially square wave shaped voltage. For this purpose amplifier A is coupled to circuit part I. In FIG. 2 this coupling and every other coupling between the different circuit parts is indicated by means of a dotted line. Amplifier A is coupled to piezotransformer PT and discharge lamp La is connected to output terminals of piezotransformer PT. The frequency of the substantially square wave shaped signal and therefore the frequency of the sinusoidally shaped signal that constitutes its first harmonic term is chosen substantially equal to one of the resonance frequencies of the piezotransformer.

II is a circuit part for adjusting the frequency of the substantially square wave shaped signal dependent upon a resonance frequency of the piezotransformer PT. Circuit part II is coupled to the piezotransformer PT and to circuit part I. Circuit part II may for instance be a so-called amplitude locked loop. During operation of the circuit arrangement, circuit part I generates a substantially square wave shaped signal that is amplified to a substantially square wave shaped voltage by means of the amplifier A. This substantially square wave shaped voltage is present at the primary side of piezotransformer PT. The sinusoidally shaped signal that is the first harmonic term of the substantially square wave shaped voltage is transformed by the piezotransformer into a sinusoidally shaped signal present at the secondary side of the piezotransformer PT. Both these sinusoidally shaped signals have a frequency that is substantially equal to the resonance frequency of the piezotransformer PT. The latter sinusoidally shaped signal is the voltage that is present across the lamp during operation. In case circuit part II comprises an amplitude locked loop, it samples the amplitude of the voltage present at the secondary side of the piezotransformer and adjusts the frequency of the substantially square wave shaped signal to a value for which the amplitude of the voltage present at the secondary side of the piezotransformer is maximal. When the lamp connected to the circuit arrangement is dimmed, its impedance and therefore the load on the piezotransformer changes. A change in the load of the piezotransformer causes a change in the resonance frequency. This change in the resonance frequency could cause the frequency of the substantially square wave shaped voltage (and therefore the frequency of its first harmonic term) to be no longer very close to the resonance frequency so that the voltage transformation ratio of the piezotransformer would drop to a relatively low value leading to a non-optimal performance of the circuit arrangement. Since, however, circuit part II automatically adjusts the frequency of the substantially square wave shaped signal, operation of the circuit arrangement under relatively unfavourable conditions is avoided. An amplitude locked loop is very well known in the art and the realization of circuit part II can be done in a favourable way making use of an integrated circuit that is specially designed for this purpose.

Circuit part II could alternatively be a so-called phase locked loop. The automatic control of the frequency of the substantially square wave shaped signal at an optimal value is in that case realized by adjusting the frequency to a value for which the phase difference between the voltage and the current present at the primary side of the piezotransformer is minimal. Like an amplitude locked loop, a phase locked loop is also very well known in the art and the realization of circuit part II can be done in a favorable way making use of an integrated circuit that is specially designed for this purpose.

In a practical embodiment of the circuit arrangement shown in FIG. 1, the frequency f1 of the substantially square wave shaped signal was chosen to be approximately 62 kHz. The lamp operated by means of the circuit arrangement was a compact low pressure mercury lamp with a nominal power of 2 Watt. When the duty cycle of the substantially square wave shaped signal was reduced from 0.59 to 0.32 the rms amplitude of the lamp current increased from 0.077 mA to 4 mA resulting in an increase in the light output of the lamp by a factor of 28.

What is claimed is:

1. A circuit arrangement for operating a discharge lamp comprising:

input terminals for connection to a supply voltage source, a DC-AC-converter coupled to said input terminals for generating a high frequency signal, a piezo-electric transformer having a primary side that is coupled to the DC-AC-converter and a secondary side that is coupled to terminals for lamp connection, and means for adjusting the light output of the lamp, characterized in that the DC-AC-converter comprises a first circuit part for generating a substantially square wave shaped signal and the means for adjusting the light output of the lamp comprises a dimming circuit coupled to the first circuit part for adjusting the duty cycle of the substantially square wave shaped signal.

2. A circuit arrangement according to claim 1, wherein the first circuit part comprises an integrated circuit.

3. A circuit arrangement according to claim 2, wherein the DC-AC-converter comprises an amplifier coupled between the first circuit part and the primary side of the piezo-electric transformer for amplifying the substantially square wave shaped signal to a substantially square wave shaped voltage.

4. A circuit arrangement according to claim 3, wherein the amplifier comprises a series arrangement of inductive means and switching means and the switching means are shunt with the primary side of the piezo-electric transformer.

5. A circuit arrangement according to one or more of the previous claims, comprising a second circuit part for adjusting the frequency of the substantially square wave shaped signal dependent upon the resonance frequency of the piezo-electric transformer.

6. A circuit arrangement according to claim 5, wherein the second circuit part comprises a phase locked loop coupled to the secondary side of the piezo-electric transformer and to the first circuit part.

7. A circuit arrangement according to claim 5, wherein the second circuit part comprises an amplitude locked loop coupled to the secondary side of the piezo-electric transformer and to the first circuit part.

8. A circuit arrangement according to claim 7 wherein the amplitude locked loop samples a voltage present at the secondary side of the piezoelectric transformer and, via the first circuit part, adjusts the frequency of the substantially square wave shaped signal so that the amplitude of the voltage at the secondary side of the piezoelectric transformer is a maximum.

9. A compact discharge lamp comprising:

a light source provided with a vessel which is closed in a gastight manner and transmissive for visible radiation, a housing connected to the light source and provided with a lamp cap, ballast means electrically connected to the light source for operating the light source and positioned at least partly in a space surrounded by the housing, characterized in that the ballast means comprises a circuit arrangement as claimed in claim 1 in which the DC/AC converter applies a square wave voltage to the primary side of the piezo-electric transformer.

10. A liquid crystal display comprising a backlight equipped with a lamp and ballast means for operating the lamp, characterized in that the ballast means comprises a circuit arrangement according to claim 1.

11. A circuit arrangement according to claim 1 wherein the DC/AC converter comprises an amplifier coupled between the first circuit part and the primary side of the piezoelectric transformer for amplifying the substantially square wave shaped signal to a substantially square wave shaped voltage.

12. A circuit arrangement according to claim 1 further comprising:

a series circuit including inductive means and a controlled semiconductor switching means coupled across said input terminals, means coupling a control electrode of the semiconductor switching means to an output terminal of the first circuit part which supplies said substantially square wave shaped signal, and means coupling the primary side of the piezoelectric transformer to a junction point in said series circuit between the inductive means and the semiconductor switching means.

13. A circuit arrangement according to claim 2 wherein the supply voltage source comprises a source of DC voltage, the circuit arrangement further comprising:

a first variable resistor coupled to said input terminals and to a first input of the integrated circuit so as to adjust the frequency of the generated substantially square wave shaped signal which is developed within the integrated circuit, an inductor and a semiconductor switching means serially connected to said input-terminals and further coupled to the primary side of the piezoelectric transformer, a second variable resistor coupled to said input terminals and to a second input of the integrated circuit so as to adjust the duty cycle of the generated substantially square wave shaped signal, and means coupling a control electrode of the semiconductor switching means to an output terminal of the integrated circuit and which supplies said substantially square wave shaped signal.

14. A circuit arrangement according to claim 13 further comprising:

a first capacitor connected in a series circuit with the first variable resistor to said input terminals, and a second capacitor connected in a series circuit with the second variable resistor to said input terminals.

15. A circuit arrangement according to claim 1 further comprising:

a series circuit including inductive means and a controlled semiconductor switching means coupled across said input terminals, means coupling a control electrode of the semiconductor switching means to an output terminal of the first circuit part which supplies said substantially square wave shaped signal, second means coupling the semiconductor switching means across the primary side of the piezoelectric transformer, and a second circuit part coupled to the secondary side of the piezoelectric transformer and to the first circuit part for adjusting the frequency of the substantially square wave shaped signal dependent upon the resonant frequency of the piezoelectric transformer.

16. A circuit arrangement according to claim 1 wherein the first harmonic of the square wave signal is approximately equal to the resonant frequency of the piezoelectric transformer.

17. A circuit arrangement according to claim 1 further comprising:

an amplifier coupled to the first circuit part and which comprises a series arrangement of inductive means and switching means and with the switching means in shunt with the primary side of the piezoelectric transformer, and the inductive means are connected in series with the primary side of the piezoelectric transformer.

18. A circuit arrangement according to claim 1 wherein the dimming circuit includes a variable resistor that controls the duty cycle of the substantially square wave shaped signal independently of the lamp voltage or current.

19. The circuit arrangement as claimed in claim 1 wherein the first circuit part comprises a single integrated circuit that adjusts the frequency and duty cycle of the substantially square wave shaped signal as a function of the supply voltage at said input terminals.

20. The circuit arrangement as claimed in claim 1 wherein the DCAC converter includes a controlled switching device that applies a square wave voltage to the primary side of the piezo-electric transformer.

21. A circuit arrangement for dimming a discharge lamp comprising:

input terminals for connection to a supply voltage source, a DC-AC converter coupled to said input terminals and including a controlled switch for generating a high frequency square wave voltage, a piezo-electric transformer having a primary side that is coupled to the DC-AC converter to receive said square wave voltage and a secondary side coupled to terminals for lamp connection, and means for adjusting the light output of the lamp which includes means coupled to the input terminals for adjusting the frequency and duty cycle of the square wave voltage as a function of a supply voltage at said input terminals.

* * * * *